United States Patent [19]

Hanson

[11] 4,267,661

[45] May 19, 1981

[54] MULTIPLE VEHICLE LAUNCHER

[75] Inventor: Stephen P. Hanson, Brea, Calif.

[73] Assignee: Marvin Glass & Associates, Chicago, Ill.

[21] Appl. No.: 113,718

[22] Filed: Jan. 21, 1980

[51] Int. Cl.[3] ..... A63H 33/00; F41B 3/02

[52] U.S. Cl. ..... 46/1 K; 124/21; 124/48

[58] Field of Search ..... 46/1 K, 81, 201, 202; 124/17, 21, 41 R, 48, 51 R

[56] References Cited

U.S. PATENT DOCUMENTS

| | | | |
|---|---|---|---|
| 2,289,702 | 7/1942 | Fast | 46/81 |
| 2,709,426 | 5/1955 | Nove | 124/21 |
| 3,293,793 | 12/1966 | Thomas | 46/81 |
| 3,774,586 | 11/1973 | Saito | 124/48 X |
| 3,908,303 | 9/1975 | McKay et al. | 46/1 K |

FOREIGN PATENT DOCUMENTS

| | | | |
|---|---|---|---|
| 795840 | 1/1936 | France | 124/21 |

*Primary Examiner*—F. Barry Shay

*Attorney, Agent, or Firm*—Mason, Kolehmainen, Rathburn & Wyss

[57] ABSTRACT

A launching device for launching toy vehicles or other objects includes a mechanism for sequentially launching of a plurality of the vehicles. The landing device includes a handle with a launching ramp defined thereon. Rotatably mounted on the handle is a vehicle support platform capable of holding a plurality of vehicles or objects to be launched. Propelling devices such as rubberbands are attached to the platform and are extended or tensioned by placement of a vehicle onto the platform. A latch is released to launch the vehicle by a trigger mounted on the handle. The toy also includes a biasing member for automatically rotating the platform relative to the launching ramp to position successive vehicles to be launched adjacent to the launching ramp. The rotating member may be a rubberband in which energy is stored by rotating or winding the platform relative to the handle through the employment of a winding mechanism.

17 Claims, 6 Drawing Figures

10
24
44
24
24
22
24
12
24
12
14
18
16
56
20

24
24
46
22
38
58
42
38
44
36
34
46
46
16
18
3
3
12
70
36
42
38
34
20
36
46
34
12
46
24

MULTIPLE VEHICLE LAUNCHER

BACKGROUND OF THE INVENTION

1. Field of the Invention

The present invention relates to a new and improved toy for launching a plurality of objects.

2. Brief Description of the Prior Art

One of the more popular types of toys for children is that involving models of racing cars wherein the cars are raced over a designated track or across a suitable surface such as a floor. These toys are popular not only due to the child's basic interest in racing cars, but also due to the action developed by such toys. Typical prior art toys of this type include a racing car, a complex and expensive track and remote control modules wherein cars are raced around the track at high speeds. Such toys are costly and time consuming to set up and operate.

Other prior art toys of this type include objects such as cars or racers that are pushed manually across the surface of a floor one at a time. Although cheaper, this latter type of prior art toy does not include substantial action for the child. Accordingly, it is desirable to provide an action toy that will propel objects such as race cars over a substantial distance while at the same time being economical to manufacture and enjoyable to the child.

SUMMARY OF THE INVENTION

An object of the present invention is to provide a new and improved toy for launching objects such as vehicles.

A further object of the present invention is to provide a new and improved toy that will sequentially launch a plurality of objects that is economical to manufacture and provides exciting action for the child using the toy.

The present invention is directed to a new and improved toy that includes a handle and a launching ramp secured thereto. Rotatably mounted on the handle is a vehicle launching platform including a plurality of slots within each of which the vehicles to be launched is positioned. The vehicle launching platform also includes a biasing means such as a rubberband against which the vehicle is pushed as it is loaded into a slot.

The toy further includes a latch in each slot to latch the vehicle to be launched into position against the bias of the rubberband. Each latch is released by a trigger pivotally mounted on the handle.

After each vehicle is launched, the vehicle loading platform is rotatably aligned with another object and slot adjacent the launching ramp. The vehicle launching platform is rotated under the influence of an element such as a rubberband that is secured to the handle and to the vehicle launching platform and may be wound by a rotatable winding member to store energy in the rubberband for use to rotate the platform.

The toy further includes an indexing mechanism that indexes the individual slots to insure their alignment adjacent to the launching ramp until the object has been launched. The toy may also include a safety lock mechanism that requires the launching ramp to be placed on a solid surface such as the ground before the objects can be launched thereby preventing objects from being launched in the direction of another child.

BRIEF DESCRIPTION OF THE DRAWINGS

The above and other objects and advantages and novel features of the present invention will become apparent from the following detailed description of the preferred embodiment of the invention illustrated in the accompanying drawings wherein.

DESCRIPTION OF THE PREFERRED EMBODIMENT

Figure 1:
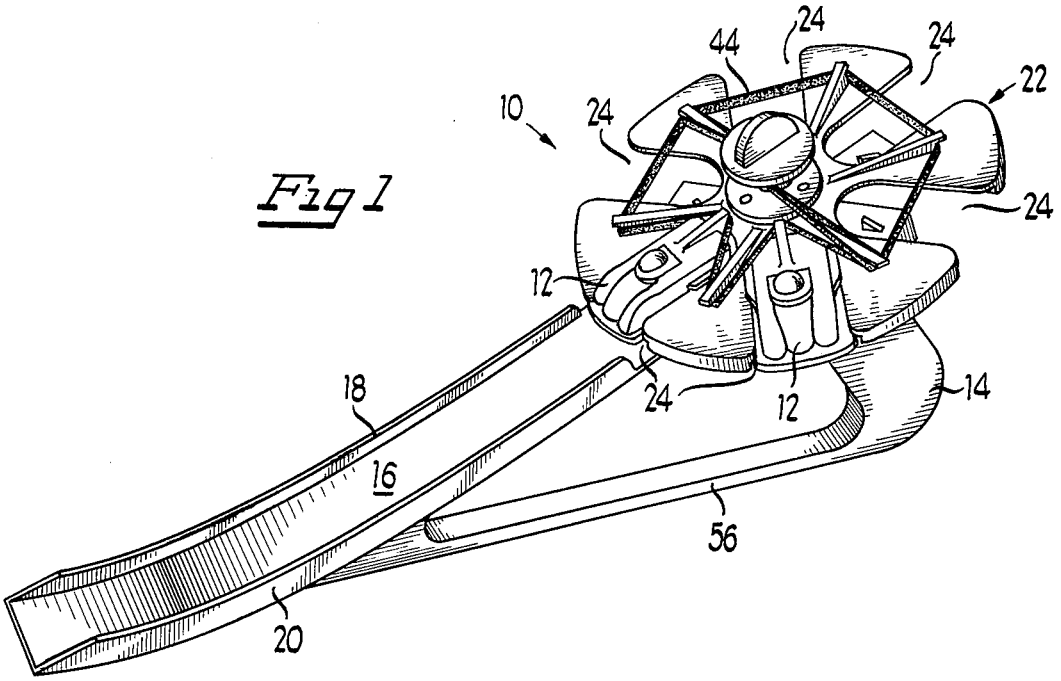
FIG. 1 is a perspective view of the preferred embodiment of the toy constructed in accordance with the principles of the present invention.

Referring now to the drawings and initially to FIG. 1, there is illustrated a toy, generally designated by the reference numeral 10, constructed in accordance with the principles of the present invention. The toy 10 is intended to launch a plurality of objects such as vehicles or cars 12 across a smooth surface, such as a floor. The toy 10 is intended to launch the cars 12 in rapid sequence, if desired, by the operator of the toy which is typically a child. As will be described herein, elaborate track or power systems are not required by the toy 10 but entertaining and rapid action is provided by the toy thereby providing increased enjoyment to the child.

The toy 10 includes a handle 14 to facilitate grasping by the user and a launching ramp 16 defined thereon. The launching ramp 16 is inclined downwardly and provides a straight track for the cars 12 to be launched thereby smoothly introducing the cars 12 onto a racing surface such as the floor or the like. The ramp 16 also serves to guide or aim the toy cars 12 in the general direction desired by the child operating the toy 10. To provide the guiding feature, the ramp 16 includes side walls 18 and 20 that are slightly wider apart than the width of the object or car 12 to be launched thereby providing a guiding function while not hampering the movement of the car 12 along the ramp 16.

The cars 12 are mounted on and latched to a vehicle launching platform generally designated by the reference numeral 22. The vehicle launching platform 22 as illustrated in the preferred embodiment is a planar member including a plurality of radial slots 24 defined therein. The vehicle launching platform 22 includes a central aperture 26 within which is mounted a bushing 28 that is secured by a press fit or other means within an aperture 30 defined within the handle 14 thereby rotatably securing the vehicle launching platform 22 to the handle 14. It should be noted that the bushing 28 in the aperture 30 is sufficient to connect the vehicle launching platform 22 to the handle 14; however, the connection is not overly tight to prevent rotation of the bushing 28 within the aperture 30.

The vehicle launching platform 22 additionally includes a latch assembly generally designated by the reference numeral 32 that is defined by a cantilevered arm 34 extending from the peripheral edge of the aperture 26 that includes on the upper surface thereof an angular latch element 36. The arm 34 further includes first depending portion 38, second right angle tab 40 and a detent 42 extending from the depending portion 38.

Figure 2:
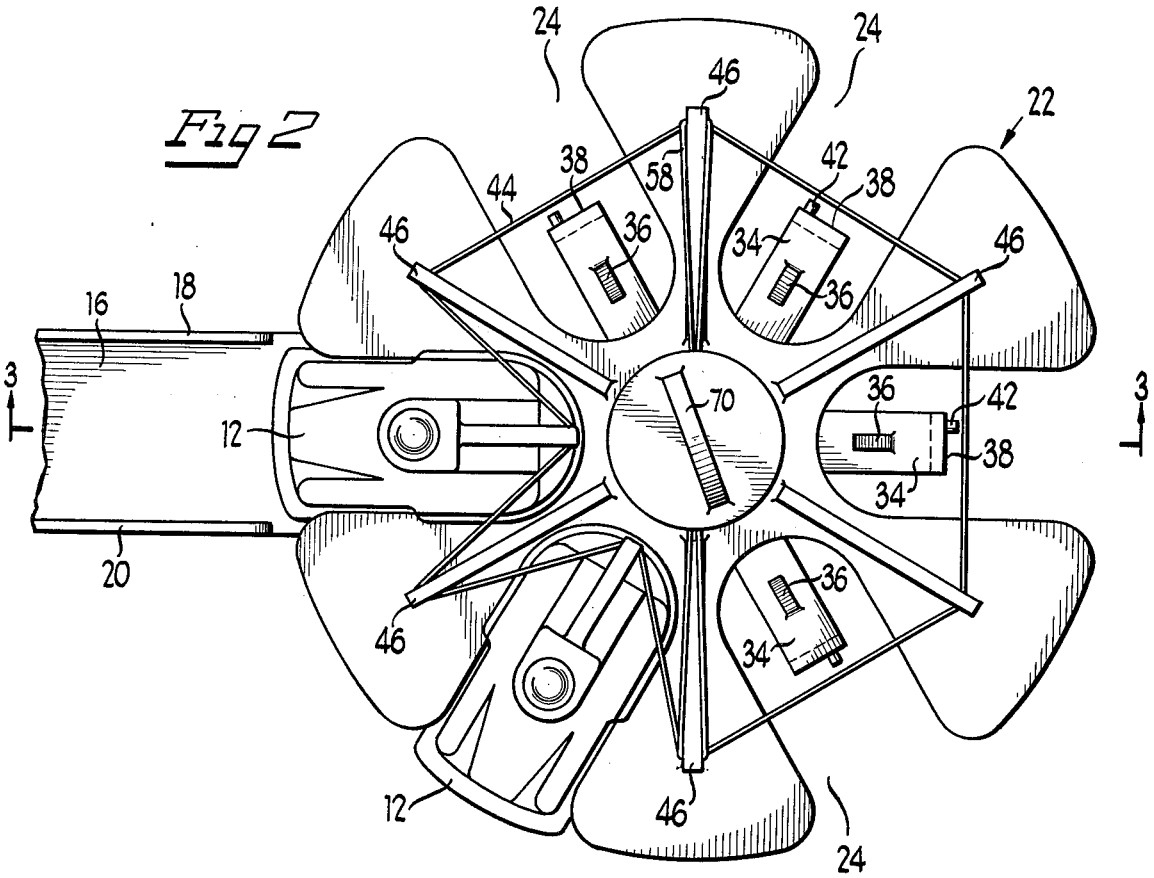
FIG. 2 is an enlarged partially fragmented top view of the toy of the present invention.
Figure 3:
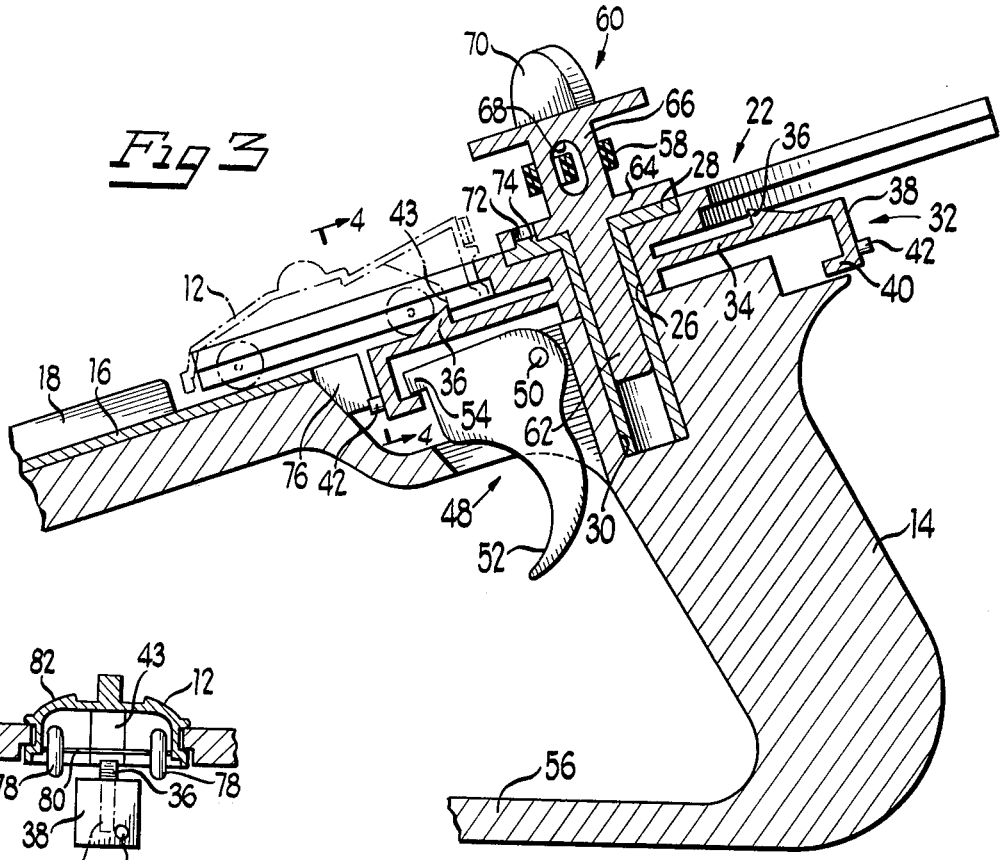
FIG. 3 is a side view taken along line 3—3 of FIG. 2.

As best illustrated in FIG. 3, each car 12 includes at the rear end thereof a catch member 42 that is latched by the vertical edge of the latch member 36 and held in place within a slot 24 until the latch element 36 is moved away from engagement with the member 42. The cars 12 are propelled down the ramp 16 by a stored energy element such as the rubberband 44 looped over integral notched wedge members 46 defined on the vehicle launching platform 22 between the slots 24. As best illustrated in FIG. 2, at the outer end of the wedge members 46, the rubberband 44 extends across the slot 24 a sufficient distance from the center of the holding member 22 such that the rubberband 44 is elongated a substantial distance upon insertion of a vehicle 12 before the latch element 36 engages the element 42 on the car 12, thus storing considerable energy in the rubberband 44 between adjacent wedge members 46.

In order to launch each car 12, a trigger, generally designated by the reference numeral 48, is pivotally mounted by a pin 50 on the handle 14. The trigger 48 includes a finger engagement portion 52 and an extending tab 54 (FIG. 3) that is positioned below and adjacent to the ramp 16. The tab extends over the right angle bend portion 40 of the latch 32. Consequently, upon pivoting the trigger 48, the finger 54 moves downwardly as viewed in FIG. 3 engaging the right angle bend 40 to move it and the arm 34 downward such that the latch member 36 is moved out of engagement with the catch member 42 releasing the car 12. The car 12 is then propelled onto the ramp 16 under the influence of the stored energy in the rubberband 44.

As illustrated, the toy 10 and particularly the handle 14 includes a bottom portion 56 that is intended to be placed on the surface over which the car 12 is to roll. If it were desired to insure that the toy 10 were placed on the ground prior to launching a car 12, the ramp 16 may be pivotally mounted to the handle 14 and could include a variety of different means for preventing actuation of the trigger 48 until the launching ramp 16 had been placed on a level surface thereby providing a safety mechanism for the toy 10 to prevent accidental launching.

Figure 5:
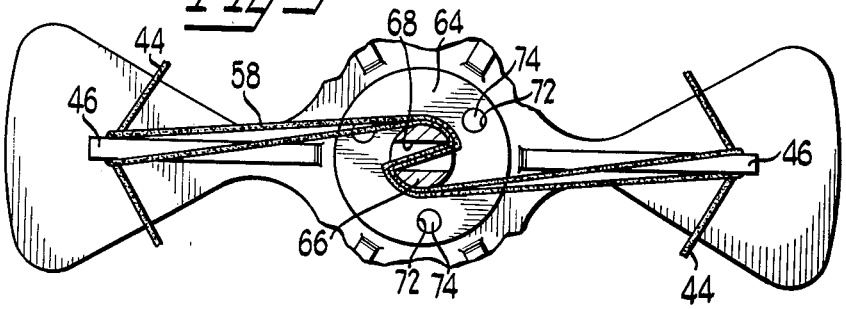
FIG. 5 is a top plan view of the winding mechanism of the toy of the present invention.

The toy 10 is also capable of sequentially rotating cars 12 into position adjacent the ramp 16 so that the child operating the toy 10 can fire or launch several cars 12 in sequence. Rotation of the holding member 22 to sequentially position cars 12 at the ramp 16 is provided by a second rubberband 58 that is looped diagonally over oppositely positioned wedges 46 and wrapped through a diametrically apertured winding element generally designated by the reference numeral 60. The winding element 60 includes a lower post 62 that extends into the bushing 28. The winding element 60 further includes an apertured disc or plate 64 with an upper extending shaft portion 66 including a diametric aperture 68 and a finger gripping portion 70 on the top thereof. As best illustrated in FIGS. 3, 5 and 6, the plate 64 of the winding member 60 includes a plurality of apertures 72 that are aligned with detents 74 defined on the upper surface of the bearing 28.

Figure 6:
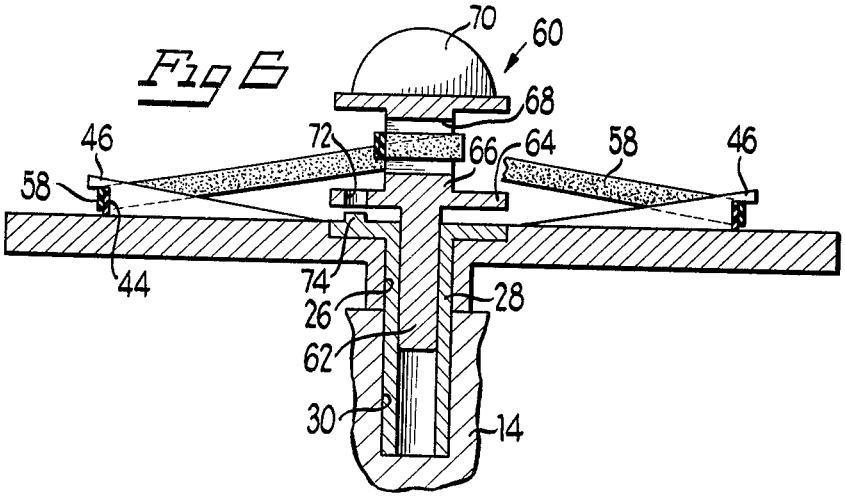
FIG. 6 is a vertical cross-sectional view of the winding mechanism of the present invention.

Since the rubberband 58 extends through the slot 68, it can be wrapped around the outer peripheral surface of the upward extending portion 66 of the winding member 60 simply by grasping the gripping portion 70 and slightly lifting the winding element 60 within the bushing 28 to a position illustrated in FIG. 6 wherein the detents 74 are out of the apertures 72. Thereafter, the winding element 60 may be rotated wrapping the rubberband 58 around the outer peripheral surface of the upper portion 66.

After sufficient energy has been stored in the rubberband 58, the winding element 60 can then be moved downwardly to place the detents 74 within the apertures 72 thus locking the winding element 60 to the holding member 22. The vehicle launching platform 22 does not rotate, however, since the detent 42 as best illustrated in FIG. 3 engages the abutment member 76 defined on the handle 14. Thus, the detents 42 and the abutment member 76 serve as an indexing mechanism assuring advancement of only one slot 24 at the completion of launching a car 12.

More specifically, to launch a car 12 by pivoting the trigger 48, the detent 42 is moved downwardly and out of engagement with the abutment member 76. Consequently, upon release of the trigger 48 after the car 12 has been launched, the rubberband 58 releases some of the stored energy to rotate the winding member 60 and the vehicle launching platform 22. As this occurs, the detent 42 on the latch immediately adjacent the ramp 16 slides under the abutment member 76 and the next slot 24 moves around to a position adjacent the ramp 16 whereupon the detent 42 of the latch 32 engages the abutment member 76 preventing further rotation of the vehicle launching platform 22 thereby aligning the next car 12 adjacent the entrance of the ramp 16 ready for launching. This sequence can be followed until all the cars 12 are launched or until the stored energy in the rubberband 58 is depleted.

Figure 4:
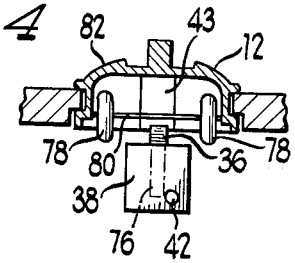
FIG. 4 is a view taken along line 4—4 of FIG. 3.

In the preferred embodiment described, the object to be launched has been illustrated as a toy car 12 that includes wheels 78 (FIG. 4) mounted on an axle 80 within a body 82 formed in the configuration of an automobile; however, as can be understood, the object 12 can be of many different configurations such as planes, trains and the like.

Many modifications and variations of the present invention are possible in light of the above teachings. Thus, it is to be understood that, within the scope of the appended claims, the invention may be practiced other than as specifically described above.

What is claimed and desired to be secured by Letters Patent of the United States is:

1. A toy for launching a plurality of objects mounted on said toy, comprising:

a vertically inclined launching ramp for launching said objects onto a surface such as a floor or the like;

a carrier for said objects to be launched rotatably mounted on said ramp;

means on said carrier for holding at least one of said objects to be launched;

launching means on said holding means for launching said object; said launching means including a stored energy element secured to said holding means in position for simultaneously biasing all of said plurality of said objects for launching each of said objects; and means for rotating said carrier to align said holding means with said launching ramp.

2. The toy as set forth in claim 1 wherein said carrier comprises a platform rotatably mounted on said handle.

3. The toy as set forth in claim 1 wherein said carrier includes first indexing means for indexing and aligning said holding means adjacent said launching ramp.

4. The toy as set forth in claim 3 further including a handle and a trigger for releasing said indexing means and allowing said carrier to rotate and for actuating said launching means.

5. The toy as set forth in claim 1 wherein said holding means includes a slot and a latch for releasably latching said object in said slot.

6. The toy as set forth in claim 1 wherein said rotating means comprises a resilient element mounted on said carrier and means for winding said carrier relative to said handle to store energy in said resilient element for rotating said carrier, and second indexing means for indexing said winding means relative to said carrier.

7. A toy for launching a plurality of objects mounted on said toy, comprising:

a handle;

a vertically inclined launching ramp secured to said handle;

means for holding said plurality of objects rotatably mounted on said handle for launching each object in a direction radially of the center of rotation of said holding means;

a first stored energy device secured to said handle and said holding means for rotating said holding means to sequentially position said objects adjacent said launching ramp; and a second stored energy device directly secured to said holding means in position for simultaneously biasing all of said plurality of objects for launching each of said objects.

8. The toy as set forth in claim 7 wherein said holding means includes a platform rotatably mounted on said handle, said platform including a plurality of slots for containing said objects.

9. The toy as set forth in claim 7 wherein said holding means further includes a plurality of latches for releasably latching said objects to said holding means.

10. The toy as set forth in claim 9 further including trigger means for releasing said plurality of latches.

11. The toy as set forth in claim 7 wherein said first stored energy device comprises a rubberband, and winding means for rotating said holding means and storing energy in said first stored energy device.

12. The toy as set forth in claim 7 wherein said second stored energy device comprises a rubberband.

13. A device for launching a plurality of objects, comprising:

a vertically inclined launching ramp;

a planar, object holding member rotatably mounted on said launching ramp;

means on said holding member for propelling said plurality of objects from said holding member in directions generally parallel to the plane of said holding member;

means on said holding member for releasably latching said plurality of objects onto said holding member;

trigger means on said device for unlatching each of said latching means;

means secured to said holding member to sequentially align said plurality of objects with said ramp upon unlatching said latching means; and means for indexing said holding member with respect to said ramp.

14. The device as set out in claim 13 further comprising a handle on said launching ramp.

15. The device as set out in claim 13 wherein said holding member further includes a plurality of slots for containing said plurality of objects and said propelling means comprises a rubberband extending across each of said plurality of slots.

16. The device as set forth in claim 13 wherein said rotating means includes a rubberband secured to said ramp and to said holding member.

17. The device as set forth in claim 13 further comprising means for winding said holding member relative to said ramp to store energy in said rotating means.

* * * * *